US006092680A

United States Patent [19]

Pillado

[11] Patent Number: 6,092,680

[45] Date of Patent: Jul. 25, 2000

[54] BABY BOTTLE ASSEMBLY

[76] Inventor: Rodolfo Mario Pillado, Los Patos 2584, CP 1643, Provincia de Buenos Aires, Argentina

[21] Appl. No.: 09/207,755

[22] Filed: Nov. 30, 1998

[51] Int. Cl.[7] ..... A61J 9/00; A61J 9/06

[52] U.S. Cl. ..... 215/11.1; 215/11.6; 248/102

[58] Field of Search ..... 215/11.1, 11.6; 248/102

[56] References Cited

U.S. PATENT DOCUMENTS

| | | | |
|---|---|---|---|
| 238,995 | 3/1881 | Van Syckel | 215/11.6 |
| 874,942 | 12/1907 | Cook | 215/11.1 |
| 1,199,025 | 9/1916 | Worlock | 215/11.5 |
| 1,267,176 | 5/1918 | Britt | 215/11.1 |
| 1,947,753 | 2/1934 | Block | 215/11.1 |
| 2,389,390 | 11/1945 | Silverman et al. | 215/11.6 |
| 2,489,773 | 11/1949 | Hall | 215/11.6 X |
| 2,514,744 | 7/1950 | Cipyak | 215/11.1 |
| 2,926,805 | 3/1960 | Mead | 215/11.1 |
| 3,049,258 | 8/1962 | Fullum | 215/11.1 |
| 3,071,272 | 1/1963 | Doner | 215/11.1 |
| 3,093,256 | 6/1963 | Woodbury, Jr. . | |
| 3,145,867 | 8/1964 | Roberts et al. | 215/11.1 |
| 3,162,318 | 12/1964 | Woodbury, Jr. . | |
| 3,253,726 | 5/1966 | Meierhoefer . | |
| 3,394,018 | 7/1968 | Velonis et al. | 215/11.6 X |
| 3,512,301 | 5/1970 | Kramer | 215/11.6 X |
| 4,832,213 | 5/1989 | Sharon et al. | 215/11.1 |
| 4,865,207 | 9/1989 | Joyner et al. | 215/11.5 |
| 5,269,426 | 12/1993 | Marano | 215/11.6 |
| 5,653,353 | 8/1997 | Otto et al. | 215/11.6 X |
| 5,878,898 | 3/1999 | Shefflin | 215/11.6 |

FOREIGN PATENT DOCUMENTS

| | | | |
|---|---|---|---|
| 2603187 | 3/1988 | France | 215/11.6 |
| 1421343 | 9/1988 | U.S.S.R. | 215/11.1 |
| 008 | of 1872 | United Kingdom | 215/11.1 |
| 24830 | of 1911 | United Kingdom | 215/11.1 |
| 188606 | 11/1922 | United Kingdom | 215/11.1 |
| 2170410 | 8/1986 | United Kingdom . | |

*Primary Examiner*—Sue A. Weaver
*Attorney, Agent, or Firm*—Malloy & Malloy, P.A.

[57] ABSTRACT

A feeding container preferably in the form of a baby bottle including an elongated body having a curved configuration along its length, wherein the body includes a hollow interior and an open end disposed in communication with the hollow interior and an oppositely disposed closed end. The body also includes a sidewall portion disposed in surrounding relation to the hollow interior and defining the boundaries thereof, wherein the sidewall includes a first portion and a substantially oppositely disposed second portion both of which have outer surfaces with predetermined curvilinear configurations. A support assembly in the form of a plurality of spaced apart support members are formed on the first portion of the sidewall and are disposed and cooperatively structured with the first portion to allow the disposition of the body in a more stable horizontal orientation without spilling or rolling. When in a supported horizontal orientation, the body is specifically configured to allow for a shifting in the center of gravity thereof dependent on the quantity of liquid material contained within the hollow interior. In any of the plurality of supported horizontal orientations, the nipple associated with the body will be maintained in an upwardly angled, "non-leak" position and in spaced relation to the supporting surface.

20 Claims, 3 Drawing Sheets

BABY BOTTLE ASSEMBLY

BACKGROUND OF THE INVENTION

1. Field of the Invention

This invention relates to a container preferably in the form of a baby bottle having a body with a support assembly mounted thereon, wherein the configuration of the body as well as the disposition and structure of the support assembly allows for the positioning of the body in a supported, horizontal orientation without risk of spilling or rolling of the body.

2. Description of the Related Art

Feeding containers, in the form of baby bottles, have greatly improved over the last few years in structural design as well as the material from which such containers are formed. Such structural and design improvements have come as a result of the obvious disadvantages associated with the production and utilization of the heavy, glass material baby bottles prevalent throughout the industry in years past. These prior art glass material containers were difficult to handle both by a parent or caretaker feeding an infant, as well as by the infant itself, when he or she became old enough to self feed without the aid of an attending adult. The glass material from which such prior art baby bottles where formed naturally increased the weight and therefore presented disadvantages associated with handling and positioning. Also, such glass material, prior art baby bottles also presented a safety factor in terms of breakage during the feeding process and/or in the heating the contents of the baby bottle.

In addition to the above, prior art feeding containers, which are generally of a straight line configuration, wherein they are structured to be normally oriented in a vertically upright position with the bottom end or base portion of the bottle specifically dimensioned and configured to be placed on a supporting surface, may significantly add to the air intake of the infant during the consumption of the milk, juice or like liquid food material contained within the baby bottle. Such excessive air intake has been recognized as a significant factor in causing colic, hiccups and other harmful maladies in the infant.

Based on the long recognized disadvantages associated with the use of prior art baby bottles and like feeding containers of the type set forth above, including the glass and straight line bottles, the industry has implemented numerous design and structural improvements in such containers. Such improvements include the use of light weight, durable plastic materials, which have proven to be safer from the stand point of breakage, such as when the baby bottle is inadvertently dropped, overheated or the like. In addition, baby bottles or like feeding containers are now available with a substantially curved, longitudinal configuration in order to facilitate the correct positioning of the container during feeding and thereby minimize air intake when the milk, food formula, or like beverage is being consumed by the infant.

Still, however, even in light of those improvements and structural changes made in the design of baby bottles and like feeding containers which are now commercially available, some of the above-recited problems associated therewith remain unaddressed. Specifically, the normal shape and configuration of conventional bottles, including the more modern shape and alternative material designs, is such that when the bottle is not being used or handled, it must be supported in a generally upright, vertical orientation on its relatively small diameter base. Naturally, such a configuration wherein a potentially top heavy configuration is disposed on a small area can lead to instability and easy tipping and therefore spilling if the bottle or a support surface is bumped by a caretaker or infant. Indeed, such is especially the case with some alternate configuration bottle shapes wherein the center of gravity of the bottle is not even centered over the base. Despite the drawbacks associated with such vertical positioning, however, the conventional shape of existing bottles does not allow for them to merely be laid down atop a support surface, as such positioning is generally unstable and susceptible to rolling, especially with odd shaped bottles and/or when liquid is contained in the bottle and/or when a support surface, such as a high chair is susceptible to movement or jarring. Also, a laid down configuration of existing bottle structures can result in spillage, even if the bottle can be propped by other objects to prevent rolling, if the fluid level is higher than the nipple of the bottle in that horizontal orientation.

Accordingly, there is still a need in the industry for a baby bottle made of a light weight, high strength, material resistant to breakage from dropping or over heating, and which can be effectively disposed in a position which is not readily susceptible to tipping over or rolling, and will not leak or spill even when the bottle is full and is supported in a horizontal orientation. Further, such an improved bottle may also incorporate a specific configuration which minimizes air intake as the infant consumes the material within the container. In addition, a preferred new design configuration of a feeding container, specifically of the type used to feed infants a liquid food product, should preferably include structure which facilitates selected, supported positioning of the feeding container on a supporting surface in any one of a variety of different horizontal, and thereby more stable, orientations, which function to minimize spillage and/or re-introduction of air therein, and which may be more convenient for manipulation of the bottle to and from the infant's mouth. In particular, such a preferred, improved feeding container should allow the container to be horizontally supported on a supporting surface in a plurality of different orientations convenient to a user, without being susceptible to rolling or spilling through a nipple of the bottle, and can also preferably allow the container to be supported in an upright, substantially vertical position if desired in some circumstances.

In any of the plurality of supported positions, whether the baby bottle is horizontally or vertically oriented, the nipple or other dispensing structure mounted on an open end thereof should also be disposed in a spaced relation to the supporting surface so as prevent the nipple or like dispensing structure from being contaminated by direct contact with the supporting surface or other objects. Moreover, the overall configuration of a preferred baby bottle or like feeding container, as well as a supporting structure associated therewith, should be such as to "automatically" orient the dispensing structure in a non-leaking position for obvious reasons.

SUMMARY OF THE INVENTION

The present invention relates to a feeding container preferably in the form of a baby bottle comprising a hollow interior body having an elongated configuration and terminating in an open end and an oppositely disposed closed end. The body includes a preferably cylindrical sidewall disposed in surrounding relation to the hollow interior and extending substantially between the open end and closed end so as to define the boundaries of the hollow interior and serve to contain a liquid food product therein.

In particular, the present invention includes a support assembly which preferably, but not necessarily, is integrally formed on the body. More specifically the support assembly comprises a plurality of spaced apart support members collectively disposed and configured relative to one another and to an outer surface of the sidewall of the body to enable the bottle to be oriented on a planar surface, such as a table or the like in at least one, but preferably a plurality of different supported, horizontal orientations. Each of the aforementioned plurality of supported horizontal orientations is more specifically defined by the outer surface of the first portion being disposed in engagement with and/or immediately adjacent to the supporting surface. Accordingly, the bottle is able to maintain a more stable orientation as a larger surface area of the bottle is in engagement with an underlying support surface and the bottle is less susceptible to tipping over. Furthermore, the configuration of the support assembly is such that the bottle will not tend to roll, such as if the support surface is moved or shaken.

The mentioned support assembly is also preferably structured to facilitate the gripping and proper orientation of the bottle by an adult while feeding the infant. Specifically, the support assembly is preferably structured such that each of the support members is defined by a somewhat elongated configuration extending transversely to the longitudinal axis of the body as well as the overall convex curve of the first portion of the sidewall. Each of the elongated configurations of the support members are further defined by oppositely disposed generally enlarged end portions. As such, more convenient handling and manipulation of the bottle is achieved, both during gripping and during placement and retrieval from the support surface due to the horizontal orientation maintained by the bottle.

Additionally, the sidewall of the bottle preferably includes the first portion extending along the length of the body substantially between the open end and the closed end. The first portion includes an outer surface which preferably has a curvilinear configuration, more specifically defined by a continuous, elongated, convex curve. In addition, the sidewall also includes a second portion substantially oppositely disposed to said first portion and also being sufficiently elongated to extend between the aforementioned open end and closed end. The second portion has an outer surface which, in a preferred embodiment, includes a more complex curvilinear configuration preferably defined by a first concave curve extending substantially from the open end of the container to approximately a transverse mid-portion of the body, and a convex curve extending from the termination of the aforementioned concave curve along the remainder of the second portion of the sidewall, to substantially the closed end of the body of the container. The curved configurations of the first portion and second portion of the sidewall, as set forth above, is such as to define the elongated, longitudinally curved configuration of the body which facilitates proper positioning of the bottle so as to eliminate or significantly restrict the intake of air while the infant is consuming the liquid food product contained within the hollow interior of the container body. In more specific terms, if the infant is being fed by an adult, the longitudinally, curved configuration of the body allows the holding and positioning of the container while feeding, in a proper orientation to effectively eliminate the intake of air. Similarly, the natural inclination of the infant, when old enough to hold the baby bottle and effectively self feed, is an upright orientation, again wherein the curved configuration of the body restricts or effectively eliminates the intake of air during the consumption of the food product contained within the hollow interior of the body.

Further, another important feature of a preferred embodiment of the present invention is the structuring of the support assembly, as set forth above, in cooperation with the configuration and dimension of the bottle such that the center of gravity of the bottle, when in a horizontal orientation, will shift, dependent on the quantity of liquid or like food product within the bottle. By way of example, when the hollow interior of the body is mostly full, or at least contains a predetermined minimum quantity, the center of gravity will be disposed adjacent a transverse mid-portion of the bottle, but closer to the closed end than the open end. Conversely, when the bottle is empty or mostly empty, the center of gravity will be positioned adjacent the transverse mid-portion of the body but closer to the open end than the closed end. More specifically, dependent upon the quantity of liquid product within the hollow interior of the container, the body will have a tendency to automatically assume a first of a plurality of supported horizontal orientations when the hollow interior is mostly full or has at least a minimum quantity therein. Conversely, when the hollow interior of the body is empty or mostly empty to the extent that a significantly less quantity of food product or liquid is within the hollow interior, the body will have a tendency to assume a second of a plurality of supported horizontal orientations. Also, each of the aforementioned plurality of supported horizontal orientations will maintain a nipple or like dispensing structure secured to the open end of the body, out of contaminating contact with a supporting surface and in what may be referred to as a "non-leak" orientation. In particular, the structure of the bottle enables the more stable and convenient horizontal orientation to be achieved, while generally upwardly angling the nipple such that a level of the liquid within the bottle will generally not be above the nipple, thereby potentially leading to spillage, when the bottle is disposed in the horizontal orientation.

Based on the above, it is a primary object of the present invention to provide a feeding container, preferably in the form of a baby bottle, structured to be disposed in a horizontal orientation on a support surface so as to minimize a risk of toppling and spillage, and which is structured to minimize rolling on the support surface.

It is another object of the present invention to provide a feeding container, preferably in the form of a baby bottle, having a hollow, elongated body formed of a lightweight, durable plastic or equivalent material specifically configured to reduce or eliminate air intake by an infant consuming the liquid contents of the container and further wherein the body of the container may be supported in a plurality of different supported horizontal orientations or a substantially, upright orientation without substantial risk of spillage.

It is a further primary object of the present invention to provide a feeding container preferably in the form of a baby bottle having a body with a curvilinear sidewall specifically configured in cooperation with a support assembly enabling the body to be positioned in a plurality of supported, horizontal orientations without a tendency to roll or permit spillage.

Another important object of the present invention is a feeding container preferably in the form of a baby bottle having a body which is dimensioned, configured and structured to be selectively positioned either in a vertically upright orientation or a plurality of supported horizontal orientations dependent, at least in part on the quantity of material contained within the hollow interior of the container.

Yet another important object of the present invention is to provide a container in the form of a baby bottle having a nipple or like liquid dispensing structure removably secured to an open end of the container and further including a protective hood removably secured in covering, enclosing relation to a portion of the dispensing structure which is designed to be engaged by the mouth of the infant during the feeding process.

Yet another object of the present invention is to provide a baby bottle container having a nipple removably secured to the open end of a hollow interior body for the dispensing of liquid material from the body and further including a protective hood structured to be disposed in enclosing relation to the nipple, wherein the hood includes a removable end cap which is structured or otherwise designed to influence the aesthetic appearance of the baby bottle.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
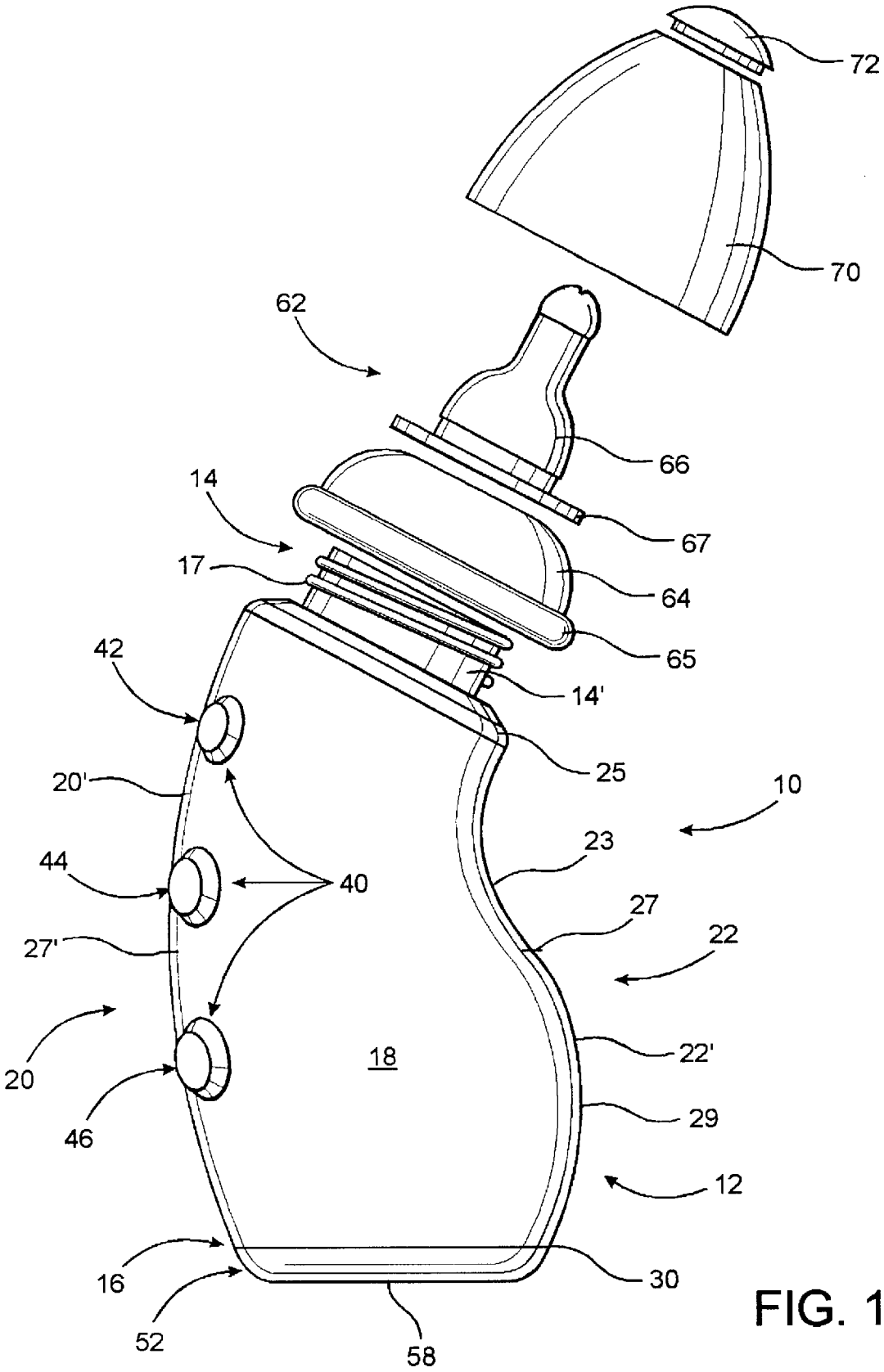
FIG. 1 is front plan view in exploded form of the various components of the present invention.

As shown in the accompanying Figures, the present invention is directed to a baby bottle assembly or like feeding container, generally indicated as 10. The baby bottle assembly 10 includes a body 12 having a hollow interior portion and terminating in an open end 14 and an oppositely disposed closed end 16. The open end 14 communicates directly with the hollow interior of the body 12 and is sufficiently dimensioned to allow the passage of a liquid material, therethrough. The liquid material preferably comprises a liquid food product of the type intended to be fed to infants including, but of course not limited to milk, juice, prepared formula, etc. The body 12 further includes a continuous, substantially cylindrical sidewall 18 having an elongated configuration and extending substantially between the open end 14 and the close end 16. In the preferred embodiment shown in FIG. 1 the sidewall 18 surrounds the hollow interior of the body 12 and is integrally or otherwise connected immediately adjacent to the open and closed ends 14 and 16 respectively so as to surround and effectively define the hollow interior of the body 12.

A primary feature of the present invention is the provision of a support assembly 40, best shown in FIGS. 1 through 4. The support assembly is generally indicated as 40 in FIG. 1 and is disposed, structured and configured to allow for the selective as well "automatic" positioning of the body 12 in at least one, but also possibly a plurality of supported horizontal orientations represented in FIGS. 3 and 4. In particular, the present invention recognizes that based upon the elongate construction of a baby bottle, they are susceptible to tipping or toppling over. As such, the support assembly 40 of the present invention is structured to effectively maintain a stable horizontal orientation to the bottle when it is not in use, and to ensure that the bottle does not tend to roll or be toppled from a support surface. Accordingly, spillage from the bottle, especially due to accidental engagement by the infant or due to a movement or shaking of the support surface, will be significantly minimized.

Figure 2:
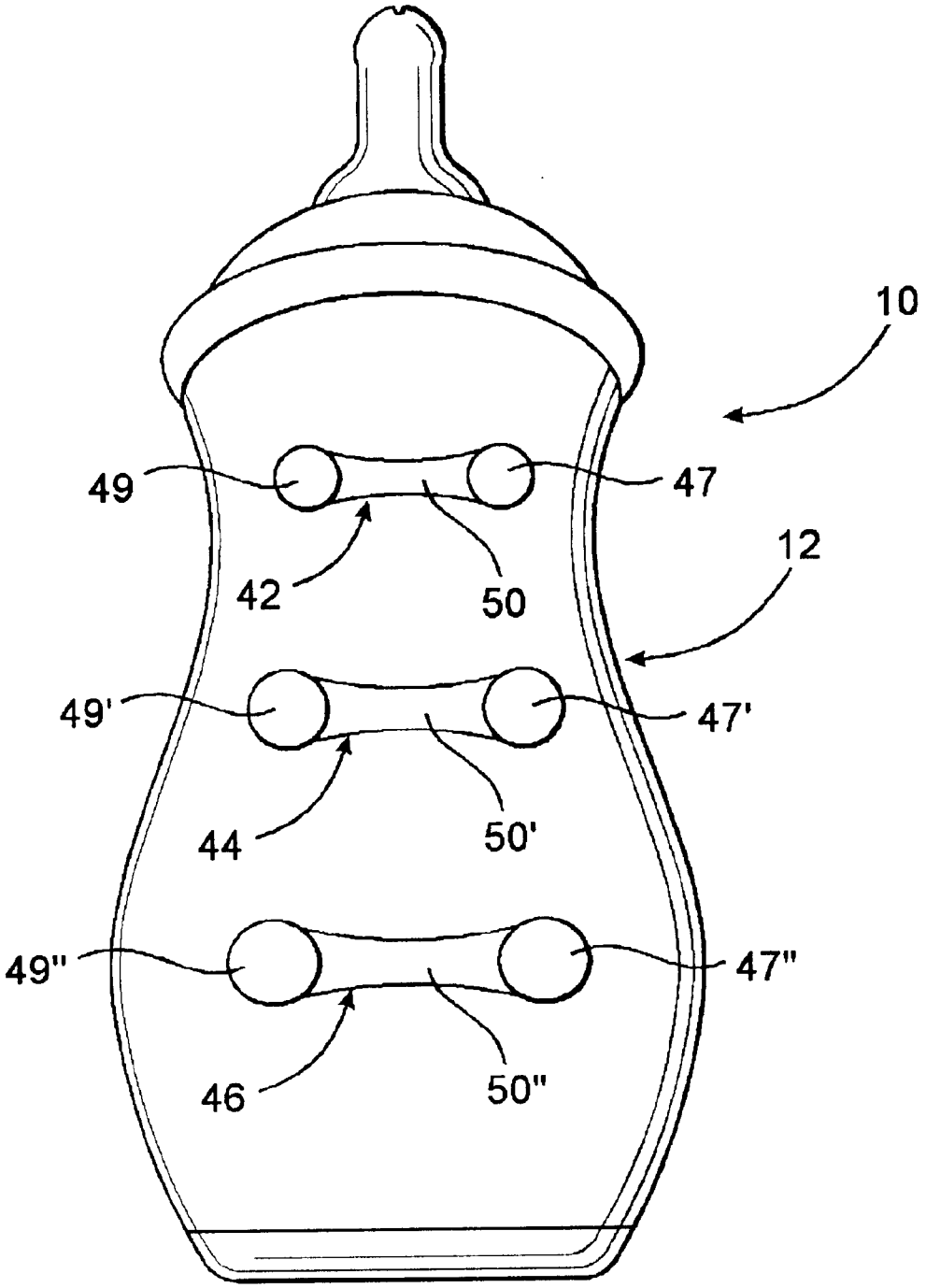
FIG. 2 is side plan view of a support assembly associated with the present invention.

Looking more specifically to the support assembly 40, it preferably comprises a plurality of support members 42, 44 and 46. Each of the support members 42, 44 and 46 are mounted on and preferably integrally formed to extend outwardly from an outer surface 20' of a first portion 20 of sidewall 18. The present invention of course contemplates the mounting or connection of the support members 42, 44 and 46 to the outer surface so as to extend outwardly therefrom in the manner shown in the accompanying Figures by means other than an integral formation with the first portion 20 of the sidewall 18. With reference to FIGS. 1 and 2, it is seen that the support members 42, 44 and 46 are spaced preferably an equal distance from one another, however, it should be noted that such distances may of course vary depending upon the overall size and configuration of body 12. In addition, in the preferred embodiment, each of the support members 42, 44 and 46 has a somewhat elongated configuration each comprising end portions which are enlarged to the extent that the end portions 47, 49; 47', 49'; and 47", 49" have a larger transverse dimension and project outwardly from the outer surface 20' of the first portion 20 a greater distance than a corresponding, substantially centrally disposed connecting portion 50, 50' and 50" respectively. Of course, it is also contemplated that the end portions be distinct elements that are separate from one another in defining each support member. Also, although three support members, each with two end portions are illustrated in the preferred embodiment, it is also contemplated that more or less total support members be provided and that more or less end portions comprise each support member. For example, a tripod configuration with two end portions defining one support member, and a single end portion defining another support member is contemplated within the scope of the present invention.

A further important feature of the present invention is the overall elongated configuration of the sidewall 18 and more specifically a generally curved longitudinal configuration of the body 12. The configuration of sidewall 18 may be more specifically defined by the provision of the first portion generally indicated as 20 and a second portion generally indicated as 22, wherein the first and second portions form integral, oppositely disposed sides of the sidewall 18. The first portion 20 of the sidewall 18, as indicated, includes an outer surface as at 20' which, in a most preferred embodiment, has an elongated curvilinear configuration more specifically defined by an elongated convex curve as shown. The convex curvilinear configuration of the outer surface 20' preferably extends along substantially the entire length of the sidewall 18 from a location substantially adjacent to the open end 14 to a location substantially adjacent to the closed end 16. However, other embodiments of the present invention are contemplated wherein the outer surface 20' includes the aforementioned convex curvilinear configuration, but wherein the length of such convex curve may be somewhat shortened such that it extends at least along the length of a support assembly associated with the first portion 20 of sidewall 18, as will be explained in greater detail hereinafter.

The sidewall 18 also includes the second portion 22 which, as set forth above, is oppositely disposed relative to the first portion 20 and which has a preferred curvilinear configuration defined by a complex curve. More specifically, the complex curve of the outer surface 22' of the second portion 22 preferably includes a concave curve segment 23 extending from a location as at 25, generally adjacent to the open end 14, to an approximate transverse mid-point as at 27. Further, the outer surface 22' includes a convex curve segment 29 extending from approximately the transverse mid-point 27 to a location as at 30 substantially adjacent to closed end 16. The outer surface 22' of the second portion 22 of sidewall 18 is integrally formed and accordingly the concave curve segment 23 integrally blends into the convex curve segment 29 so as to provide a free flowing form and a continuous, uninterrupted outer surface 22' extending from the location 25 generally adjacent the open end 14 to the location 30 generally adjacent the closed end 16.

Looking again to the support assembly 40, as best shown in FIG. 2 the spacing between end portions, as defined in the preferred embodiment by the length of the various support members 42, 44 and 46, may vary in accordance with and generally proportional to the transverse dimension or inner diameter of the body 12 and corresponding to their respective locations on the outer surface 20' of the first portion 20 of the sidewall 18. As clearly represented in FIG. 2, the support member 46 preferably has a greater length than that of the intermediate support member 44 primarily due to the fact that the location of the support member 46 extends along a transverse segment of the sidewall 18 of the first portion 20, which has a greater inner diameter than does a transverse segment corresponding to the intermediate support member 44.

Figure 3:
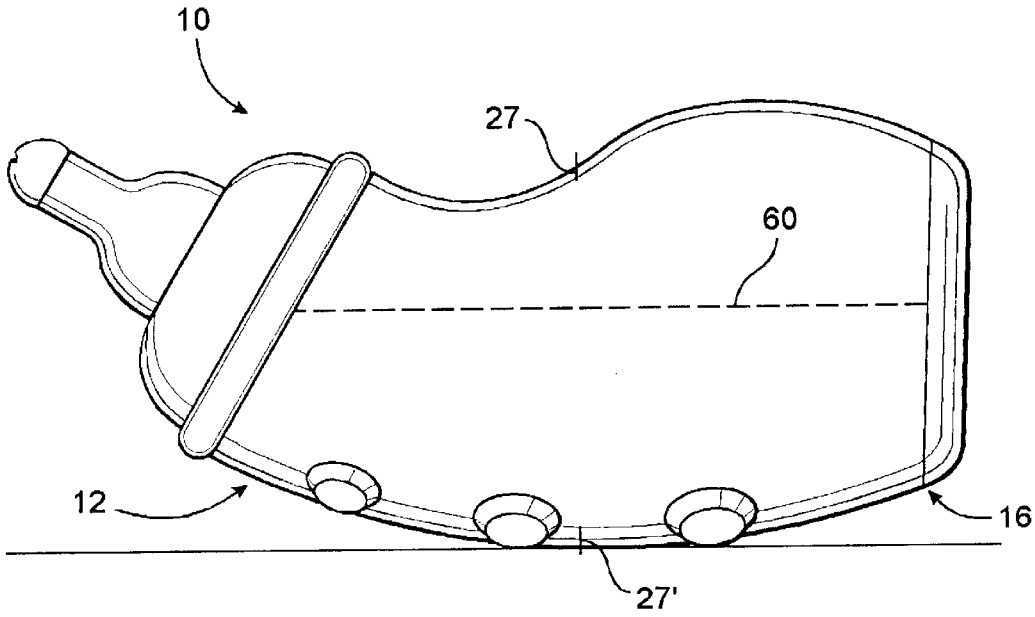
FIG. 3 is a side view with the feeding container of the present invention disposed in one of a plurality of supported, horizontal orientations.
Figure 4:
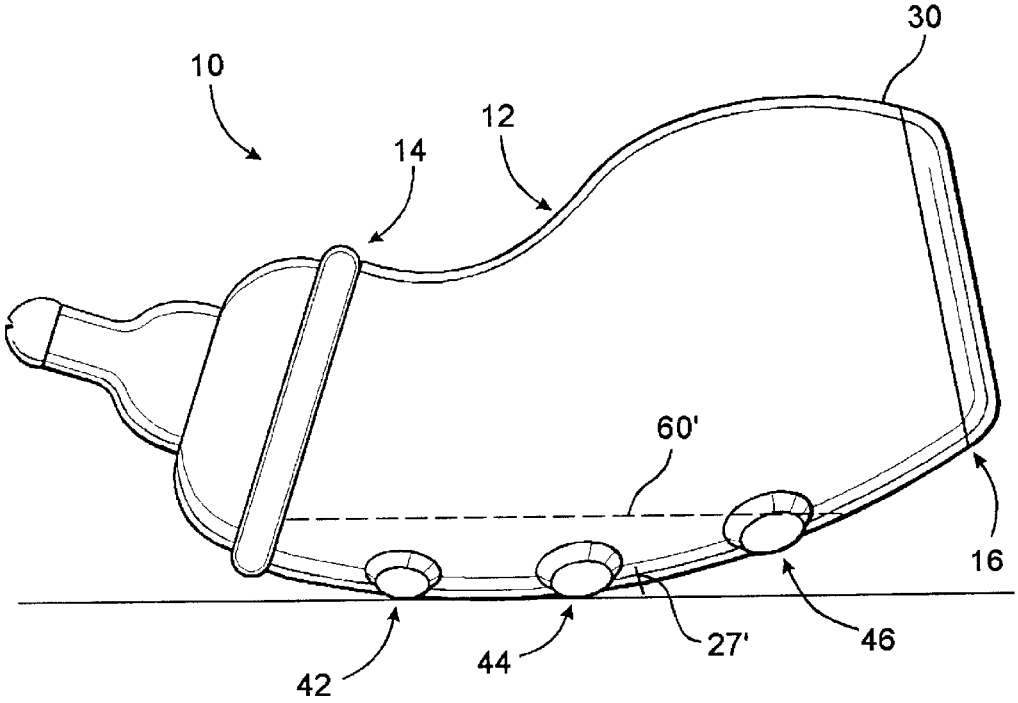
FIG. 4 is a side view similar to that of FIG. 2 wherein the feeding container of the present invention is disposed in another of a plurality of supported horizontal orientations.

Moreover, the structure of the support assembly 40, collectively defined by the disposition and structure of the preferred support members 42, 44 and 46 in cooperation with the configuration of the outer surface 20' of first portion 20, allows the body 12 to be either selectively disposed or "automatically" positioned in at least one, but preferably a plurality of supported horizontal orientations as represented in FIGS. 3 and 4. It should be emphasized that the provision of the elongated convex curve of outer surface 20' and the cooperative structuring and disposition of the support assembly 40, relative to the outer surface 20', results in a "shift" in the center of gravity of body 12, at least partially dependent on the quantity of material within the hollow interior of the body 12. More specifically, in the supported, horizontal orientation of body 12, as represented in FIG. 3, phantom line 60 is provided to indicate the quantity of material contained within the hollow interior. With reference to FIG. 3, it is seen that the quantity of liquid material maintained within the hollow interior or body 12, represented by level line 60 is significantly greater than the quantity of liquid material within the hollow interior of the embodiment of FIG. 4 which is represented by level line 60'. Accordingly, when the quantity of material 60 is sufficient to occupy a significant predetermined portion of the hollow interior or is "mostly full" the center of gravity is located generally between an imaginary, transverse mid-point 27, 27' of body 12 and the closed end 16. Conversely, when the quantity of material 60' is significantly less and is generally considered to be mostly empty (or completely empty) the center of gravity of body 12 shifts generally to a location between the imaginary transverse mid-point 27, 27' and the open end 14. Therefore the cooperative structuring between the support assembly 40, the overall configuration of body 12, and the specific, preferred configuration of the outer surface 20' of the first portion 20 of sidewall 18, allows for the "automatic" positioning of the body 12 in a plurality supported, horizontal orientations more specifically defined by a first supported horizontal orientation of FIG. 3 and a second supported horizontal orientation of FIG. 4 dependent on the quantity of material within the hollow interior of the body 12.

From the preceding, it is seen that the disposition of the support members 42, 44, 46 also ensures that the baby bottle assembly 10 is effectively maintained in a horizontal orientation during use, and does not tend to roll or otherwise shift into a position wherein spilling could occur. Also, because of the preferred shape of the body 12, it is noted that the open end 14 tends to be angled upward when in the preferred horizontal orientation. As such, even if the bottle is somewhat full, and would normally be above the height of the nipple so as to result in spilling, the nipple, to be described in further detail subsequently, is elevated and no spillage occurs. Indeed, this is particularly beneficial when a full bottle is being stored, such as in a bag or stroller. Preferably, it is, the configuration of the support assembly 40 which prevents the body 12 from rolling, that also maintains that upwardly angled orientation at the open end 14 when disposed on a support surface. Furthermore, while feeding, the preferred feeding orientation of the bottle is generally maintained so as to more conveniently manipulate the bottle for introduction into the infants mouth and so as to avoid the re-introduction of air bubbles if the bottle is returned to a vertical orientation.

Other structural features of the preferred embodiment include a base generally indicated as 52, which may be removably attached, and is disposed so as to generally define a portion of the closed end 16 of body 12. The outer most end surface as at 58 of the base 52 is specifically configured and dimensioned, relative to the overall configuration of body 12, to facilitate a stable, substantially vertically upright supported orientation of the body 12 as best pictured in FIG. 1, if desired.

Yet other structural features include a dispensing assembly, generally indicated as 62 which, in the preferred embodiment of FIG. 1, comprises an attachment cap 64 and a nipple 66. The attachment cap 64 is internally threaded and thereby removably secured about the annular collar 14' of the open end 14 by a threaded connection as at 17. The nipple 66 has an outwardly extending annular flange as at 67 which is secured on the interior of attachment cap 64 in a well known, conventional manner. The dispensing structure 62 may also include a protective hood or cover 70 having a hollow interior and dimensioned and configured to be removably secured in an enclosing, covering relation to the nipple 66 as well as a majority of the remainder of the dispensing structure 62. The hood 70 may be snap fitted or otherwise removably attached to a correspondingly positioned portion of the dispensing structure 66 such as the outer, annular projection 65 of the attachment cap 64.

Further, a removably attached end cap 72 is preferably provided and may be snap fitted, threaded or otherwise removably secured to the end portion of the protective hood 70. The outer surface and/or overall structural configuration of the end cap 72 may vary in order to enhance or otherwise affect the aesthetic appearance of the protective hood 70 as well as the overall baby bottle 10 as desired.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A baby bottle assembly designed to be positioned on a supporting surface in a plurality of supported orientations, said assembly comprising:

a) a body having an elongated configuration comprising a hollow interior including an open end and oppositely disposed closed end, b) said body further including a sidewall extending substantially between said open end and a closed end and disposed in surrounding relation to said hollow interior, c) said sidewall including a first portion extending along a length of said body from substantially said open end to substantially said closed end, and d) a support assembly mounted on said sidewall along said first portion and being structured to maintain said body in at least one horizontal orientation on the supporting surface, e) said support assembly comprising a plurality of support members mounted on said first portion in spaced relation to one another and extending outwardly from an outer surface of said first portion in engageable relation to the supporting surface, and f) at least some of said support members including a substantially elongated configuration and including enlarged, oppositely disposed end portions.

2. A baby bottle assembly designed to be positioned on a supporting surface in a plurality of supported orientations, said assembly comprising:

a) a body having an elongated configuration comprising a hollow interior including an open end and oppositely disposed closed end, b) said body further including a sidewall extending substantially between said open end and said closed end and disposed in surrounding relation to said hollow interior, c) said sidewall including a first portion extending along a length of said body from substantially said open end to substantially said closed end, d) said first portion including an outer surface comprising a curvilinear configuration extending along at least a portion thereof, e) a support assembly mounted on said sidewall along said first portion and being structured to maintain said body in at least one horizontal orientation on the supporting surface, f) said support assembly including at least two support members mounted on said first portion in spaced relation to one another, and extending outwardly from said outer surface in engageable relation to the supporting surface, and g) at least some of said support members including a substantially elongated configuration extending transversely to a length of said curvilinear configuration, each of said elongated support members including enlarged, oppositely disposed end portions.

3. An assembly as recited in claim 2 wherein said support assembly and said first portion are cooperatively disposed and structured to orient and maintain said open end in a generally upwardly angled, non-leaking position when said body is disposed in said horizontal orientation.

4. An assembly as recited in claim 2 wherein said support assembly is structured to maintain said body in one of a plurality of horizontal orientations dependent at least in part on a quantity of material within said hollow interior.

5. An assembly as recited in claim 4 wherein said support assembly and said first portion are cooperatively disposed and structured to orient said open end in a non-leaking position when said body is disposed in any of said plurality of horizontal orientations.

6. An assembly as in claim 5 wherein said non-leaking position is substantially defined by said open end disposed in an outwardly and upwardly extending relation to the supporting surface.

7. An assembly as in claim 6 wherein said plurality of horizontal orientations comprise at least a first orientation and a second orientation; said first orientation defined by said open end disposed a first distance above the supporting surface and said second orientation defined by said open end disposed a second distance above said supporting surface; said second distance being greater than said first distance.

8. An assembly as recited in claim 5 wherein said sidewall and said support assembly are cooperatively structured to shift a center of gravity of said body dependent on the quantity of material within said hollow interior.

9. An assembly as recited in claim 8 wherein said plurality of horizontal orientations comprise a first orientation assumed by said body when said hollow interior is mostly empty and the center of gravity is located closer to said open end than said closed end.

10. An assembly as recited in claim 9 wherein said plurality of horizontal orientations comprise a second orientation assumed by said body when said hollow interior is mostly full and said center of gravity is located closer to said closed end than said opened end.

11. An assembly as recited in claim 4 wherein said curvilinear configuration of said outer surface of said first portion comprises an elongated convex curve extending along at least a majority of the length of said body between said open end and said closed end.

12. An assembly as recited in claim 11 wherein said convex curve extends continuously along the length of said body substantially between said open end and said closed end.

13. An assembly as recited in claim 2 wherein said end portions of each of said elongated support members extend outwardly from said outer surface a greater distance than a remainder of each corresponding elongated member.

14. An assembly as recited in claim 2 wherein said plurality of support members comprise at least three support members each having an elongated configuration and being integrally formed on said sidewall and disposed in substantially equally spaced, substantially parallel relation to one another.

15. An assembly as recited in claim 14 wherein each of said three support members has a length generally proportional to a transverse dimension of said body at a respective location of said three support members on said sidewall.

16. An assembly as recited in claim 2 further comprising a base mounted on said body adjacent said closed end and disposed and structured to maintain said body in a substantially vertically upright, supported orientation.

17. An assembly as recited in claim 2 further comprising a dispensing assembly removably attached to said body in cooperative relation to said open end and in fluid communication with said hollow interior, said dispensing assembly comprising:

a) a nipple;

b) a hood portion removably mounted in enclosing, covering relation to said nipple; and c) an end cap removably mounted on an outer end of said hood.

18. A baby bottle assembly designed to be positioned on a supporting surface in a plurality of supported orientations, said assembly comprising:

a) a body having an elongated, substantially curved configuration along its length and including an open end and an oppositely disposed closed end, b) said body further including a sidewall extending substantially between said open end and said closed end and disposed in surrounding relation to said hollow interior;

c) said sidewall having a first portion and a second portion substantially oppositely disposed relative to one another and extending longitudinally along said body between said open end and said closed end, d) said first portion including a first outer surface and said second portion including a second outer surface; each of said first and second outer surfaces comprising a curvilinear configuration extending along at least a majority of a length thereof, e) a support assembly mounted on said sidewall along said first portion and being structured to maintain said body in one of a plurality of substantially horizontal orientations on the supporting surface, f) said support assembly being further disposed and configured to determine the horizontal orientation assumed by said body dependent at least in part on a quantity of material contained within said hollow interior, g) a base mounted on said body adjacent said closed end and disposed and structured to maintain said body in a substantially vertically upright supported orientation, h) said support assembly including a plurality of support members mounted on said first portion in spaced relation to one another and extending outwardly from said outer surface in engageable relation to the supporting surface, i) at least some of said plurality of support members including a substantially elongated configuration extending transversely to the length of said curvilinear configuration, and j) each of said support members including enlarged, oppositely disposed end portions, each of said end portions of each of said elongated support members extending outwardly from said first outer surface a greater distance than a remainder of each corresponding elongated member.

19. An assembly as in claim 18 wherein said plurality of horizontal orientations comprise at least a first orientation and a second orientation; said first orientation defined by said open end disposed a first distance above the supporting surface and said second orientation defined by said open end disposed a second distance above said supporting surface; said second distance being greater than said first distance.

20. An assembly as recited in claim 18 wherein said curvilinear configuration of said first outer surface comprises an elongated convex curve extending continuously along the length of said body substantially between said open end and said closed end.

* * * * *